US006430834B2

(12) United States Patent
Myers et al.

(10) Patent No.: US 6,430,834 B2
(45) Date of Patent: Aug. 13, 2002

(54) INSTALLATION TEMPLATE FOR A DOOR CLOSER

(75) Inventors: Christopher Roger Myers; Craig Lawrence Lucas, both of Princeton; Thomas Ned Trumpinski, Sublette; James E. Jensen; Charles T. Barth, both of Princeton, all of IL (US)

(73) Assignee: Schlage Lock Company, Colorado Springs, CO (US)

( * ) Notice: Subject to any disclaimer, the term of this patent is extended or adjusted under 35 U.S.C. 154(b) by 0 days.

(21) Appl. No.: 09/961,736

(22) Filed: Sep. 24, 2001

Related U.S. Application Data

(62) Division of application No. 09/247,129, filed on Feb. 9, 1999, now Pat. No. 6,317,996.

(51) Int. Cl.[7] ..... B43L 7/00; E04F 21/00

(52) U.S. Cl. ..... 33/566; 33/194

(58) Field of Search ..... 33/194, 562, 563, 33/565, 566, 666, 667, 669, 613, 645, 758, 679.1, 494; 283/103

(56) References Cited

U.S. PATENT DOCUMENTS 2,742,705 A * 4/1956 Gelardi ..... 33/758
2,932,897 A * 4/1960 Huber ..... 33/758
3,526,947 A * 9/1970 Pasek ..... 33/562
3,795,983 A * 3/1974 Gallagher et al. ..... 33/563
4,367,590 A * 1/1983 Winter et al. ..... 33/758
4,425,391 A * 1/1984 Wilson ..... 33/758
4,640,019 A * 2/1987 Paley ..... 33/563
4,827,621 A * 5/1989 Borsuk ..... 33/758
4,969,273 A * 11/1990 Richards ..... 33/667
5,666,737 A * 9/1997 Ryan, III ..... 33/562
6,067,722 A * 5/2000 Goodyear et al. ..... 33/758
6,317,996 B1 * 11/2001 Myers et al. ..... 33/194

* cited by examiner

*Primary Examiner*—Christopher W. Fulton
(74) *Attorney, Agent, or Firm*—Michael Best & Friedrich LLP

(57) ABSTRACT

An installation template for installing a door closer. The installation consists of an under sheet coated with a release agent and two installation templates, a pull side template and a push side template, both coated with a self-stick adhesive, attached to the under sheet. The pull side template and the push side template include two sets of written instructions, each set being upside down to the other set, which permits each template to be used for both right hand and left hand installations. The use of both pull side and push side templates on the single under sheet along with the two sets of written instructions, allows a single template to be used for both push side installation and pull side installation of both right hand and left hand doors.

2 Claims, 17 Drawing Sheets

| |
|---|
| Fig. 12A |
| Fig. 12B |
| Fig. 12C |

| |
|---|
| Fig. 12A |
| Fig. 12B |
| Fig. 12C |

| |
|---|
| Fig. 12A |
| Fig. 12B |
| Fig. 12C |

| |
|---|
| Fig. 13A |
| Fig. 13B |
| Fig. 13C |

| |
|---|
| Fig. 13A |
| Fig. 13B |
| Fig. 13C |

| |
|---|
| Fig. 13A |
| Fig. 13B |
| Fig. 13C |

INSTALLATION TEMPLATE FOR A DOOR CLOSER

RELATED APPLICATION

This is a division of patent application Ser. No. 09/247,129, filed Feb. 9, 1999 now U.S. Pat. No. 6,317,996.

BACKGROUND OF THE INVENTION

This invention relates generally to installation of door closers and more particularly to an installation template for installing a door closer.

State of the art installation instruction sheets for door closers provide the installer with a diagram of the installation and the required installation dimensions. To install the closer the installer requires a tape measure and a tool to mark the measurements. In a few cases, the manufacturer will provide a template that the installer can attach to the door to locate the door closer and arm attachment. The installer must have tape or other means to attach the template to the door and frame. In all cases known to the inventors hereof, this template is handed, i.e., one template is provided for right hand doors and a second separate template is provided for left hand doors.

The foregoing illustrates limitations known to exist in present door closer installation templates. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an installation template for use with a door mounted within a door frame and a door closer having a mounting bracket and a rod and shoe bracket, the template comprising: a sheet having a release agent on both sides thereof; a pull side template having a self-stick adhesive on one side thereof, the pull side template self-stick adhesive side being attached to a first side of the sheet; and a push side template having a self-stick adhesive on one side thereof, the push side template self-stick adhesive side being attached to a second side of the sheet.

The foregoing and other aspects will become apparent from the following detailed description of the invention when considered in conjunction with the accompanying drawing figures.

BRIEF DESCRIPTION OF THE DRAWING FIGURES

Figure 1:
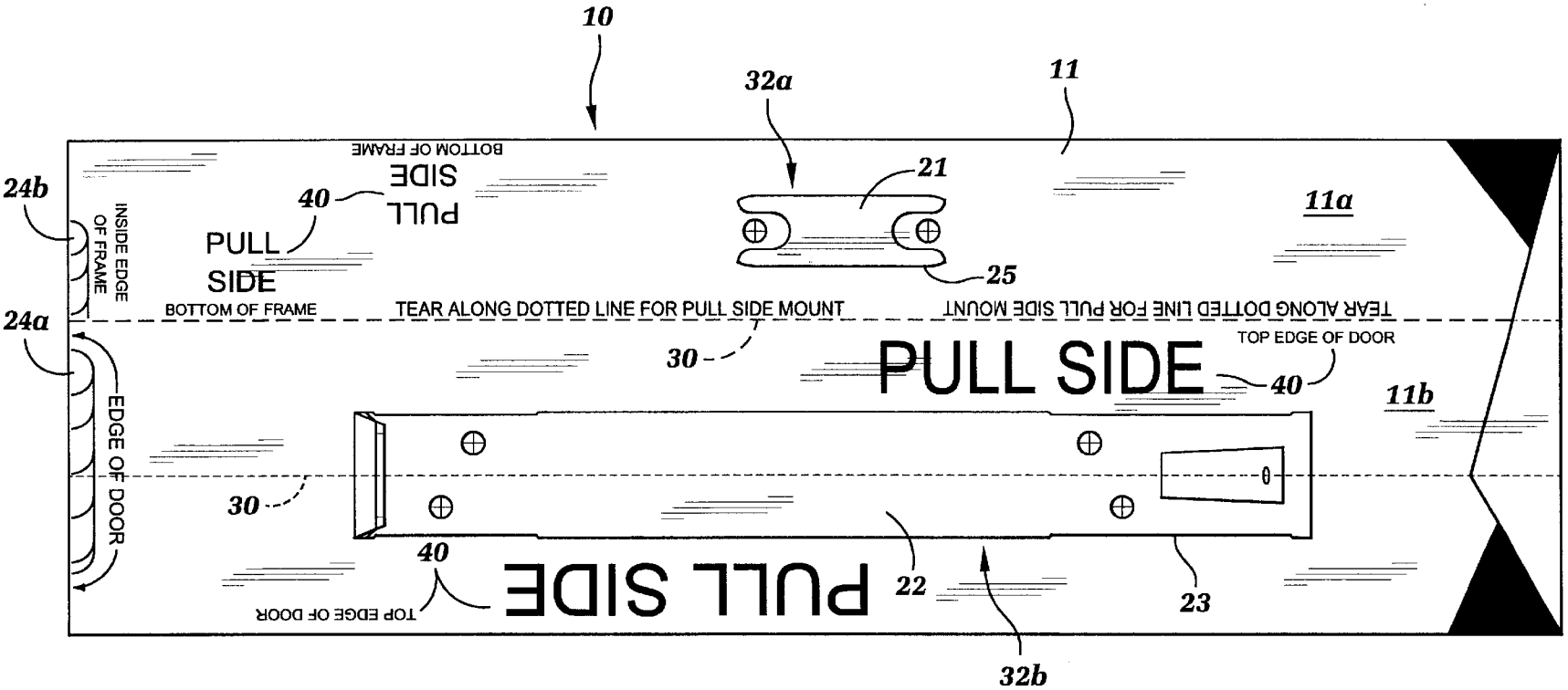
FIG. 1 is a front view of the pull side of the installation template of the present invention.
Figure 2:
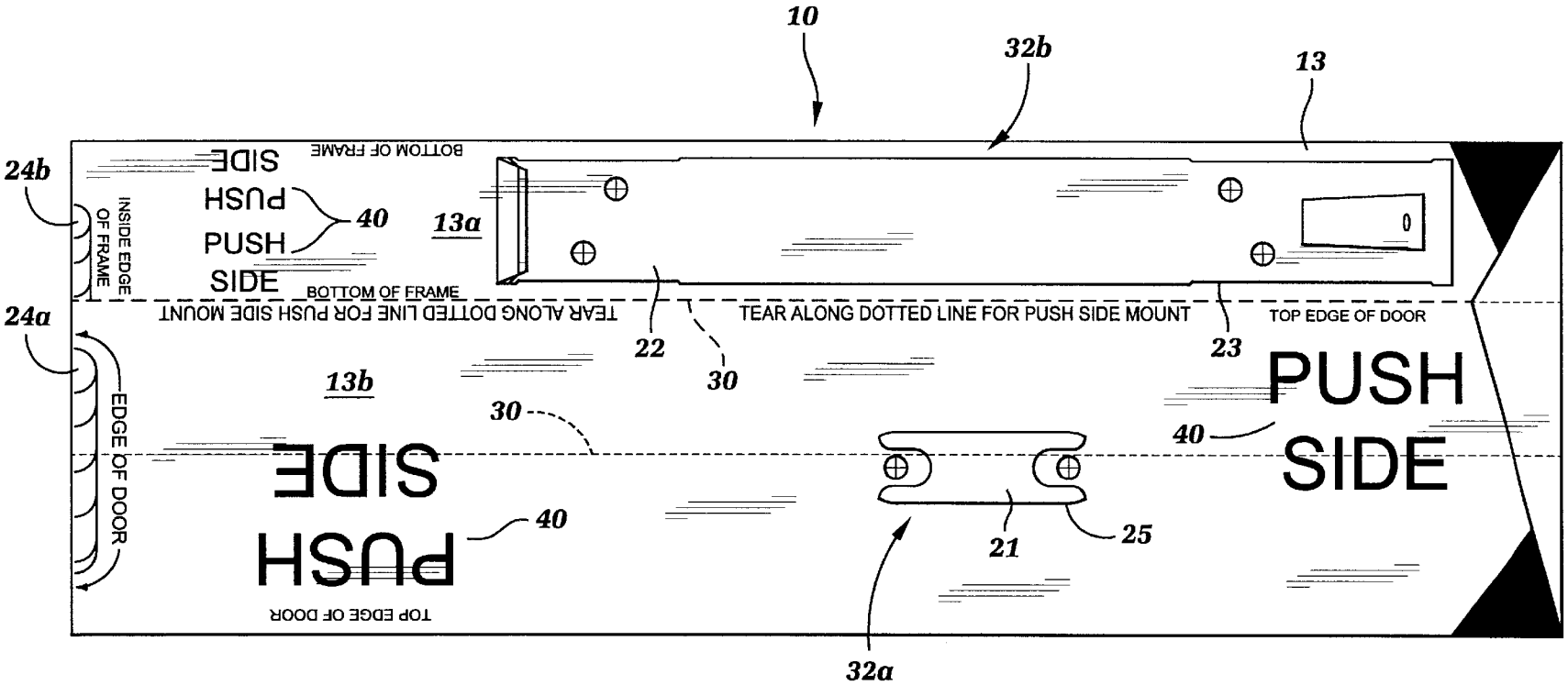
FIG. 2 is a front view of the push side of the installation template of the present invention.
Figure 6A:
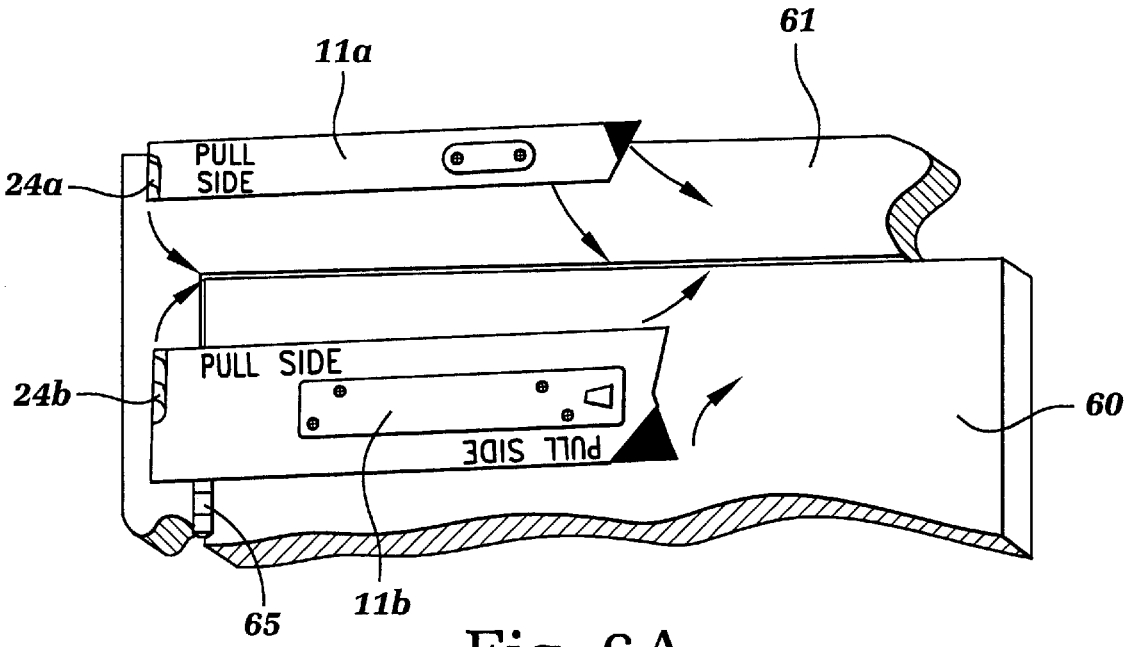
Figure 6B:
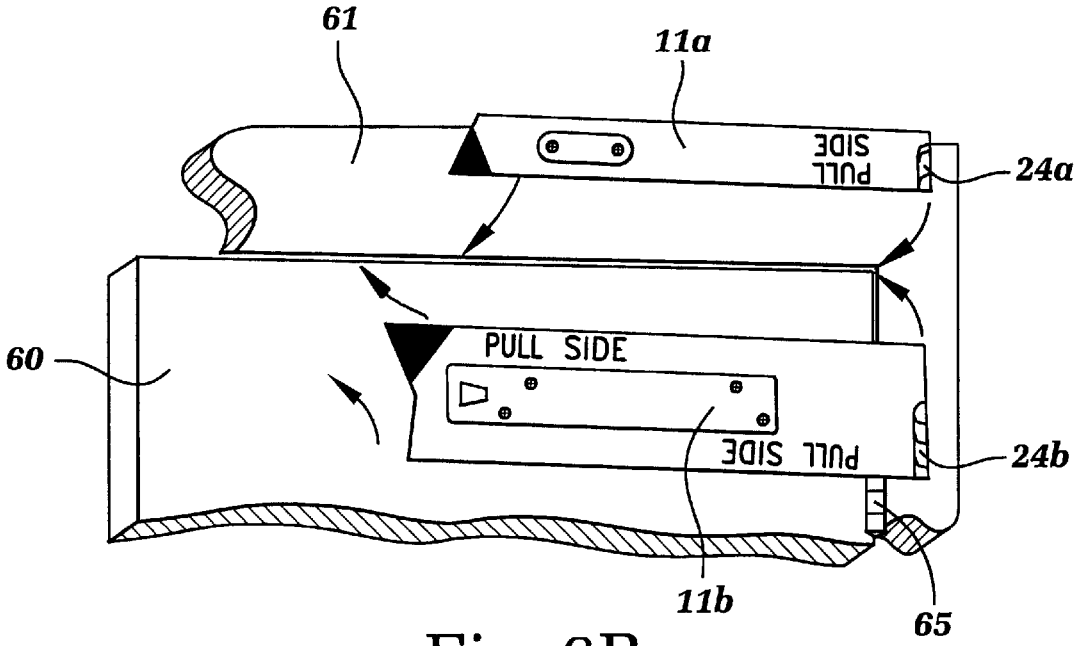
Figure 7A:
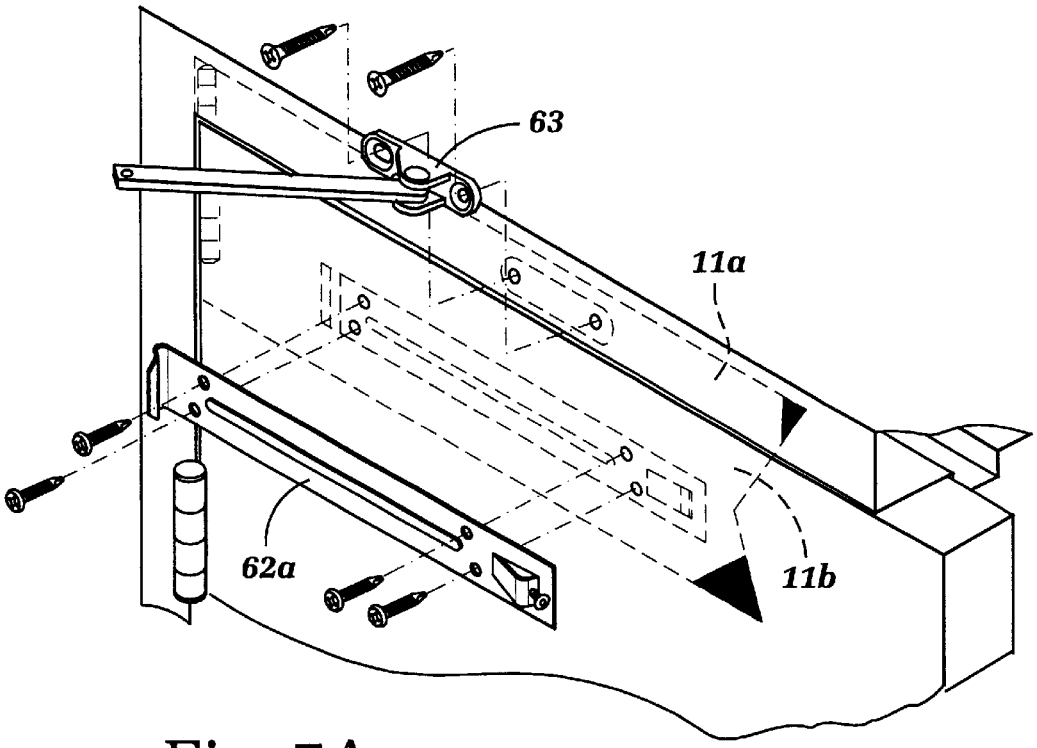
Figure 7B:
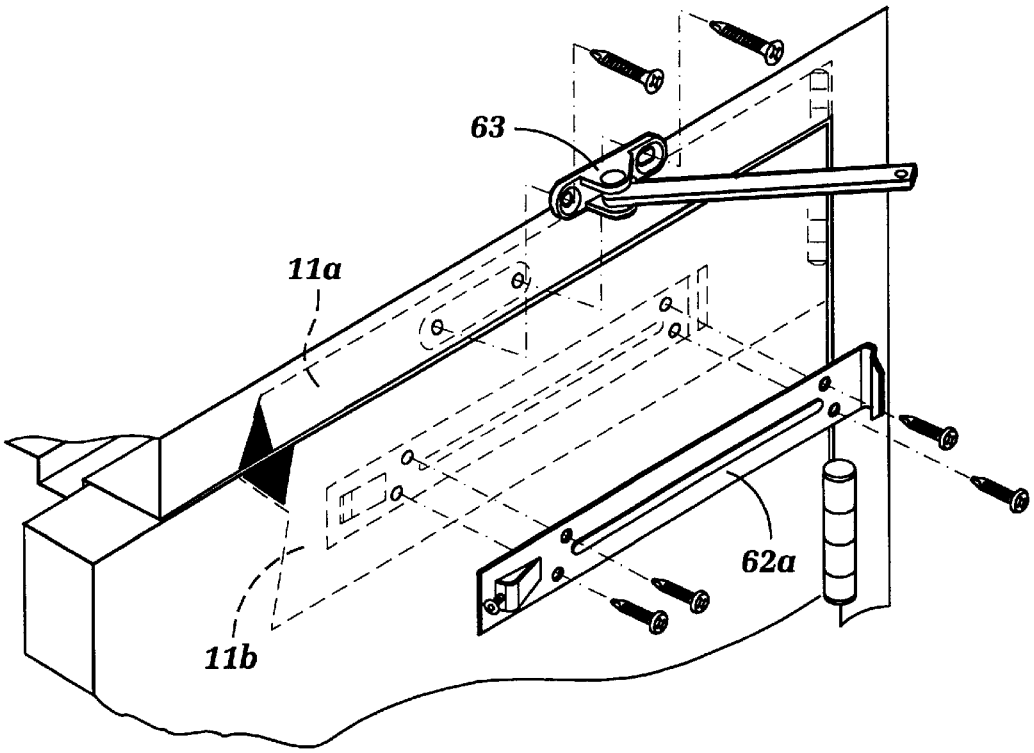
Figure 8A:
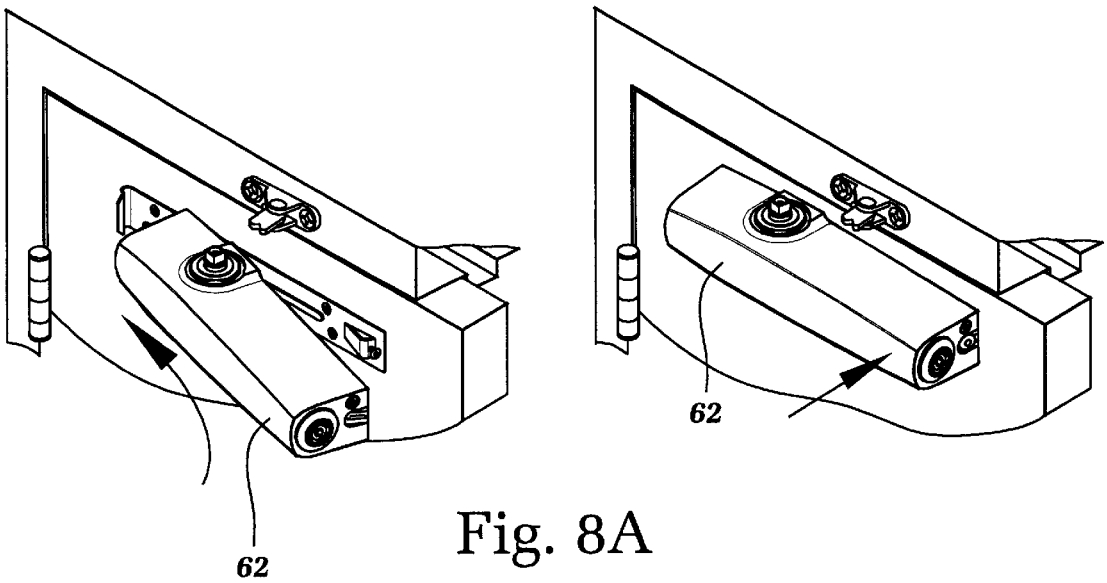
Figure 8B:
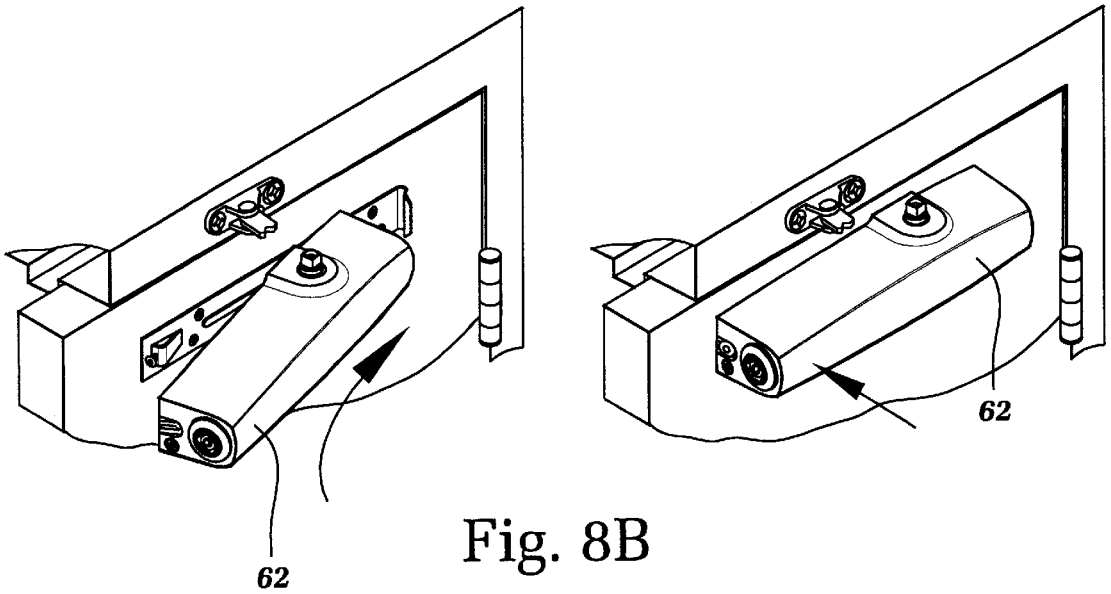
Figure 9A:
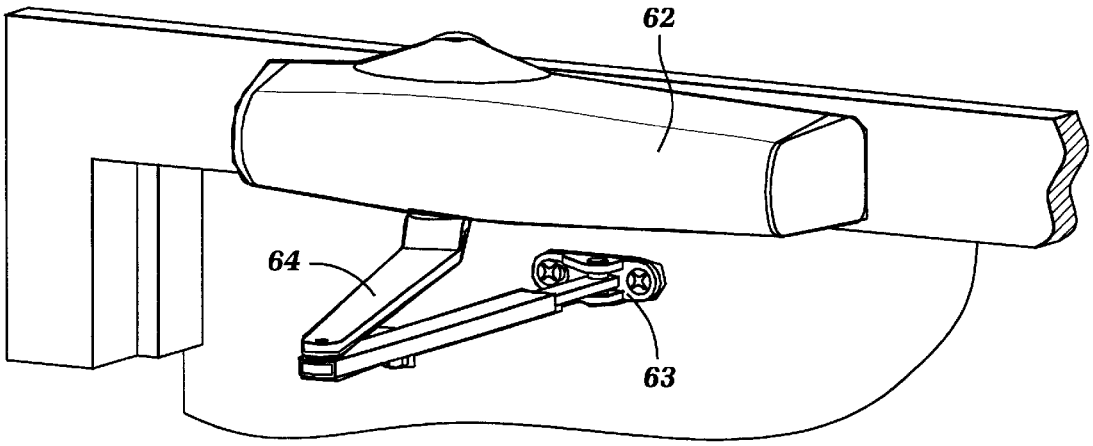
Figure 9B:
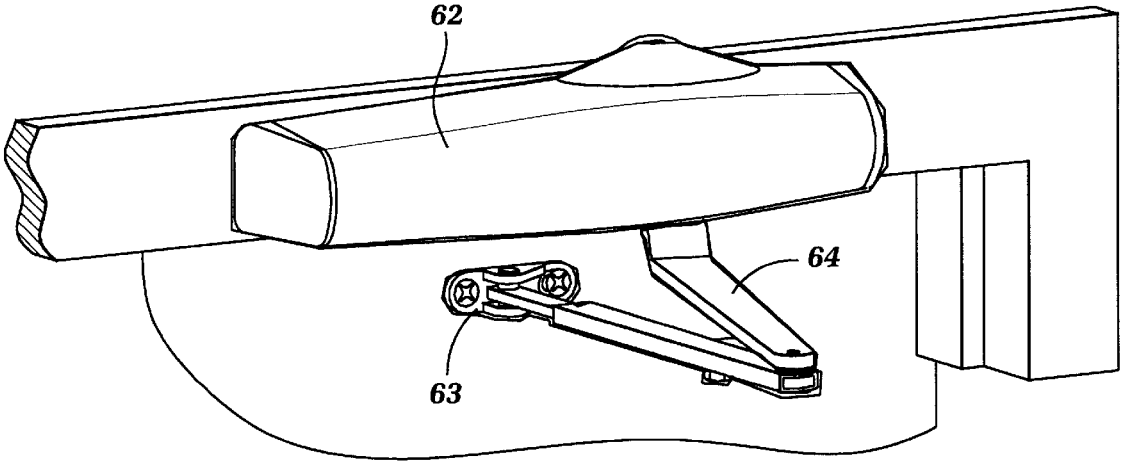
Figure 10A:
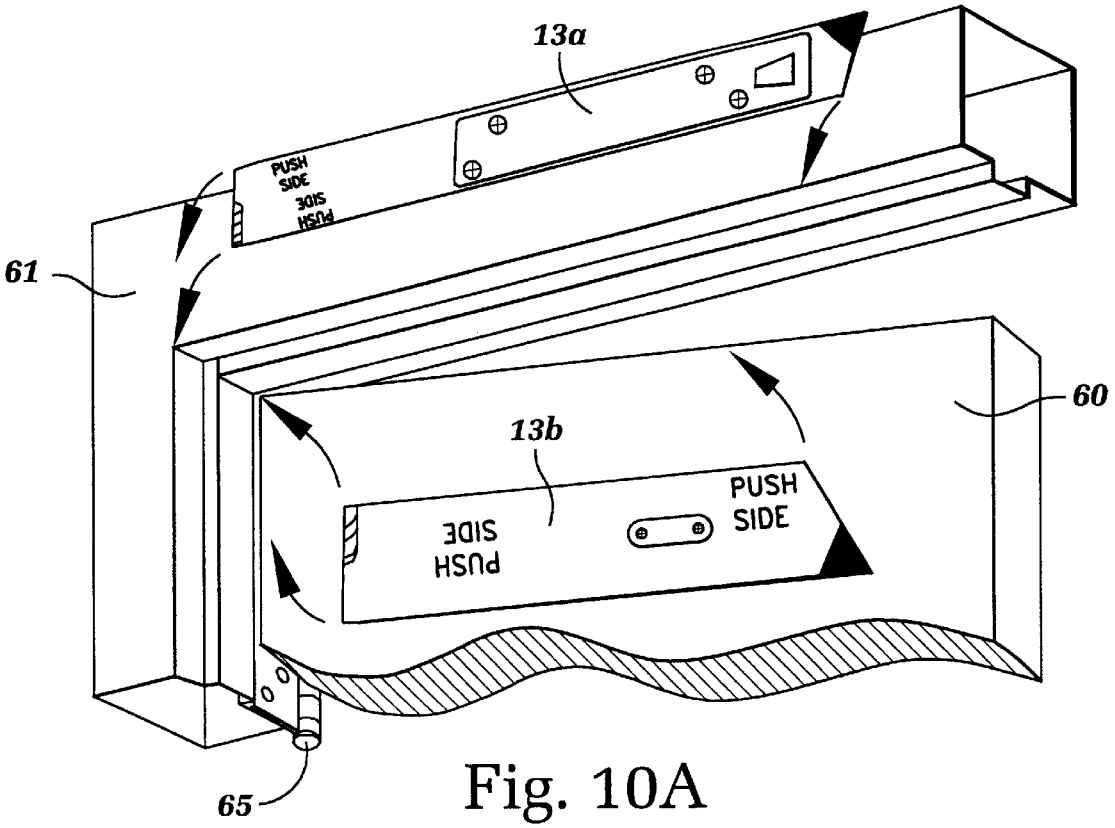
Figure 10B:
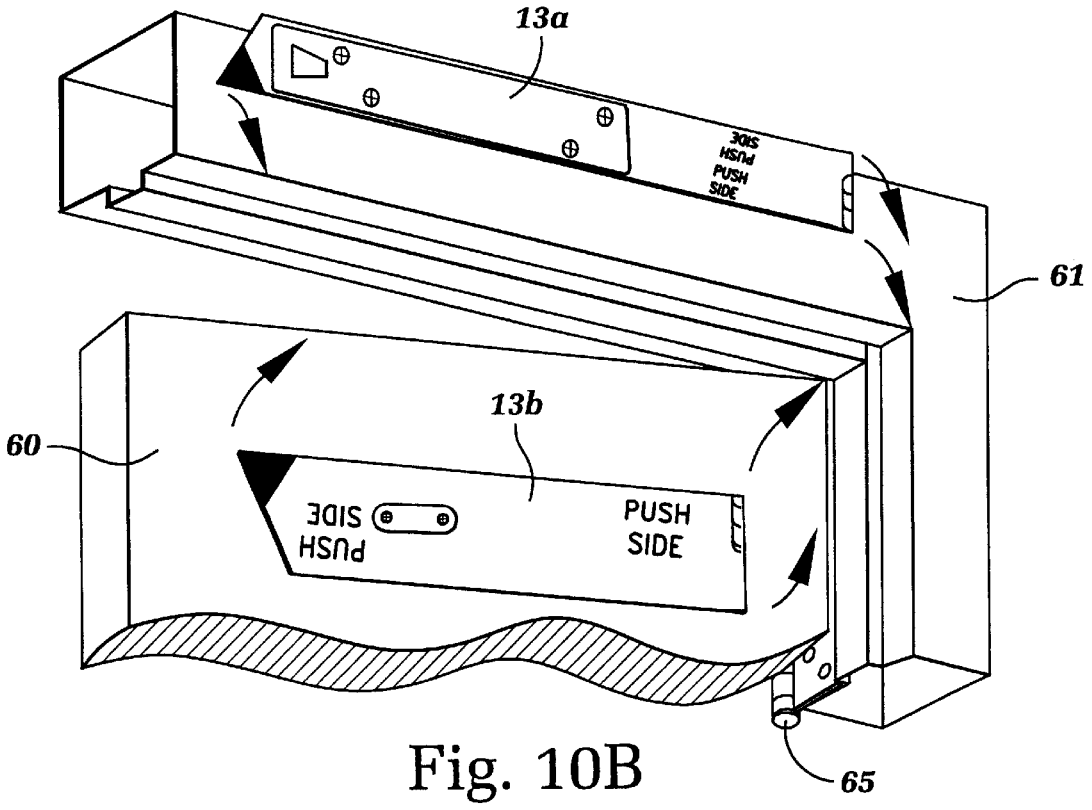
Figure 11A:
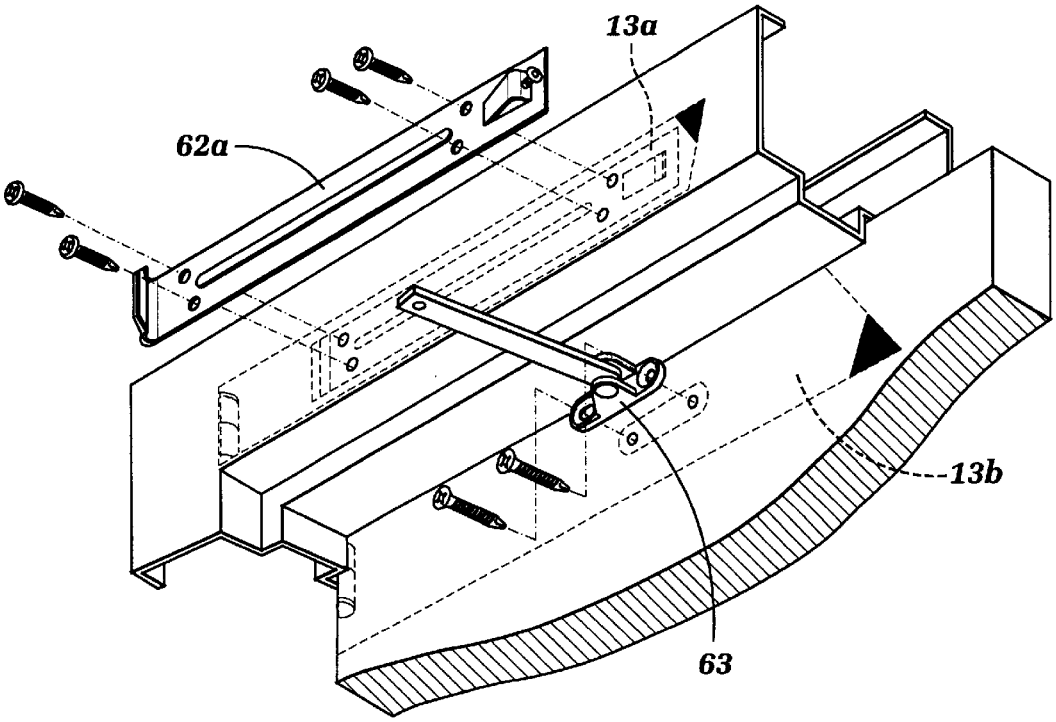
Figure 11B:
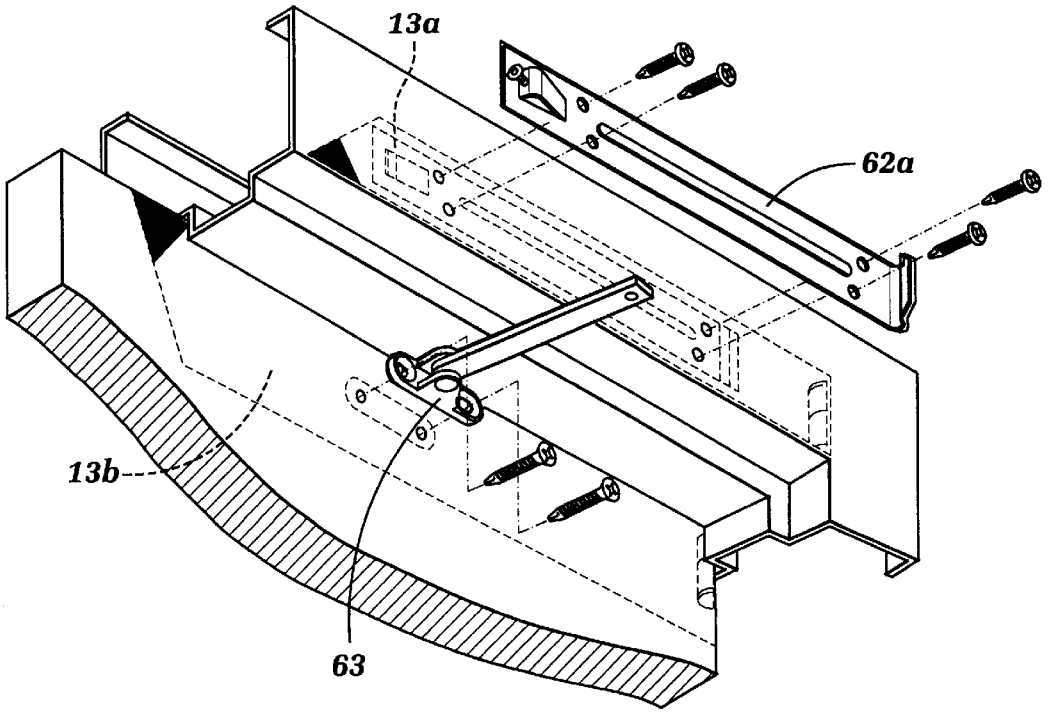
Figures 12, 12A:
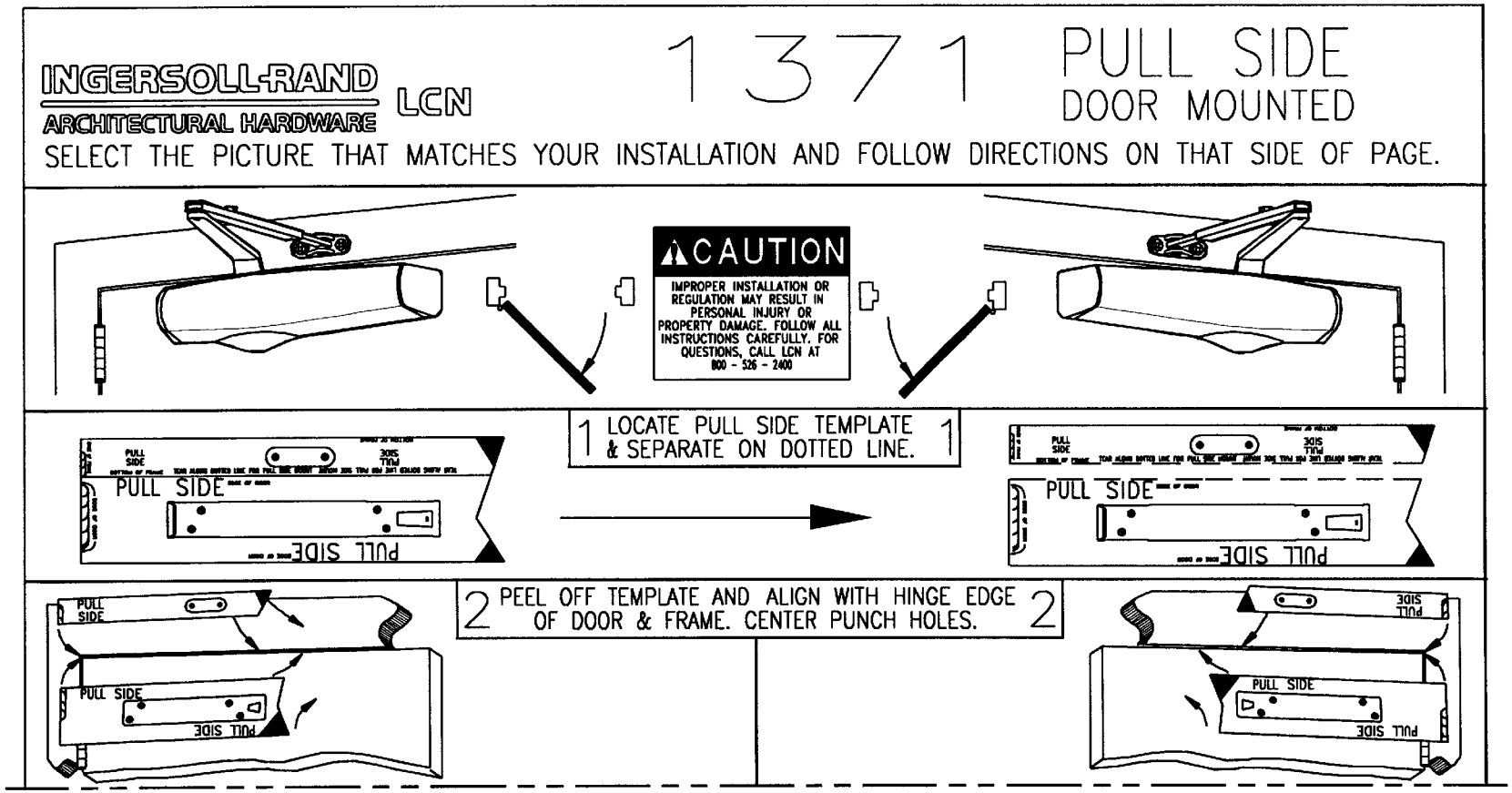
Figures 12, 12B:
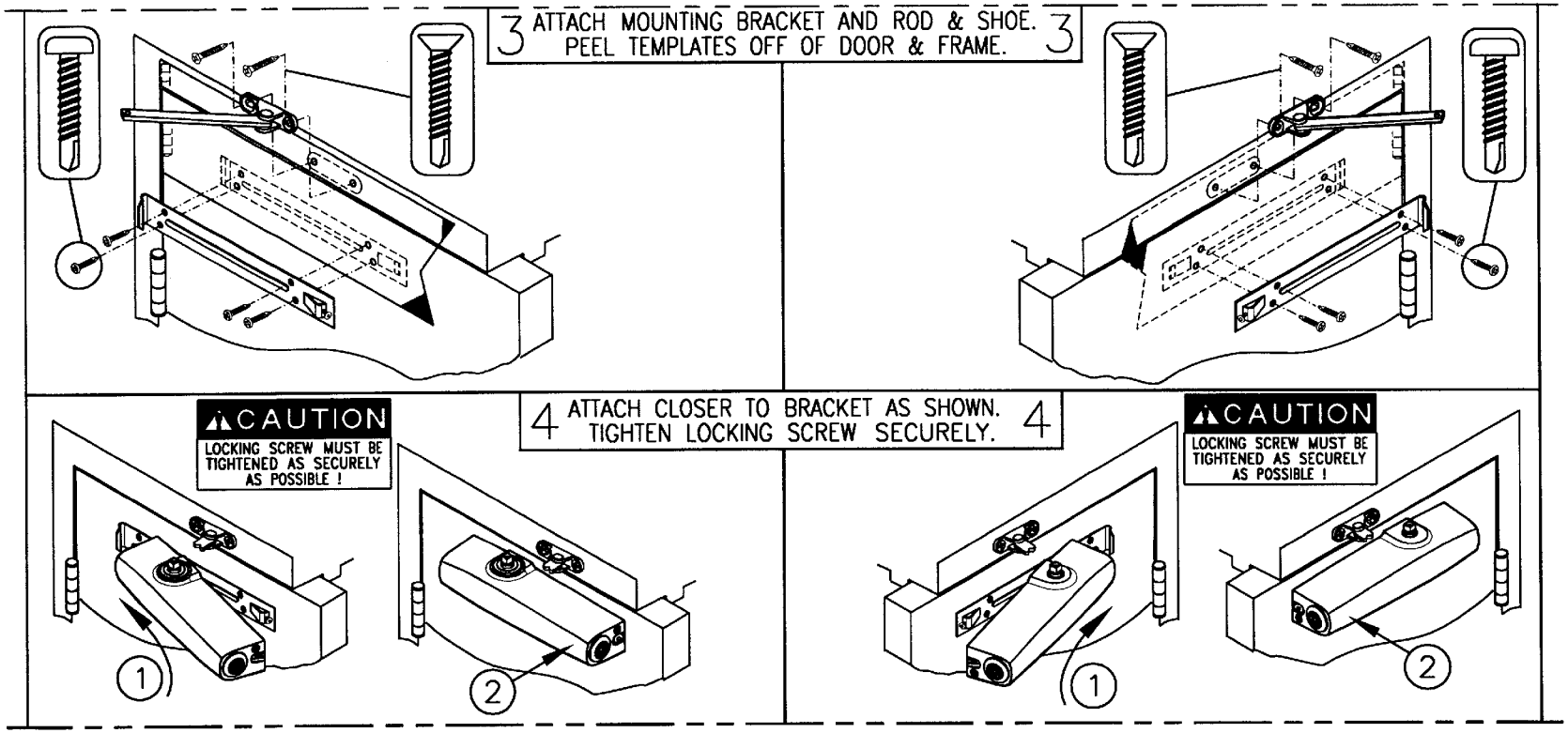
Figures 12, 12C:
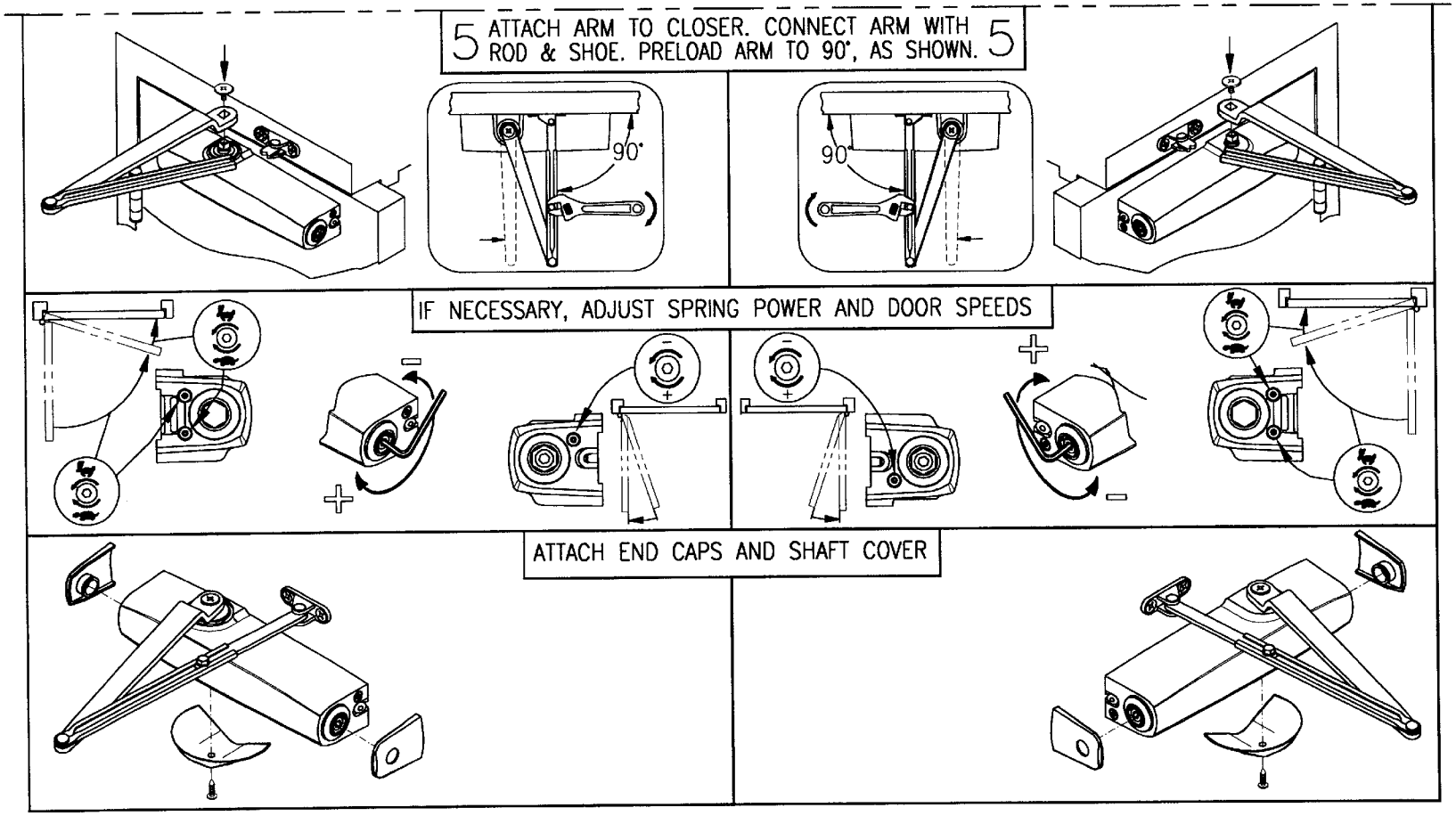
Figures 13, 13A:
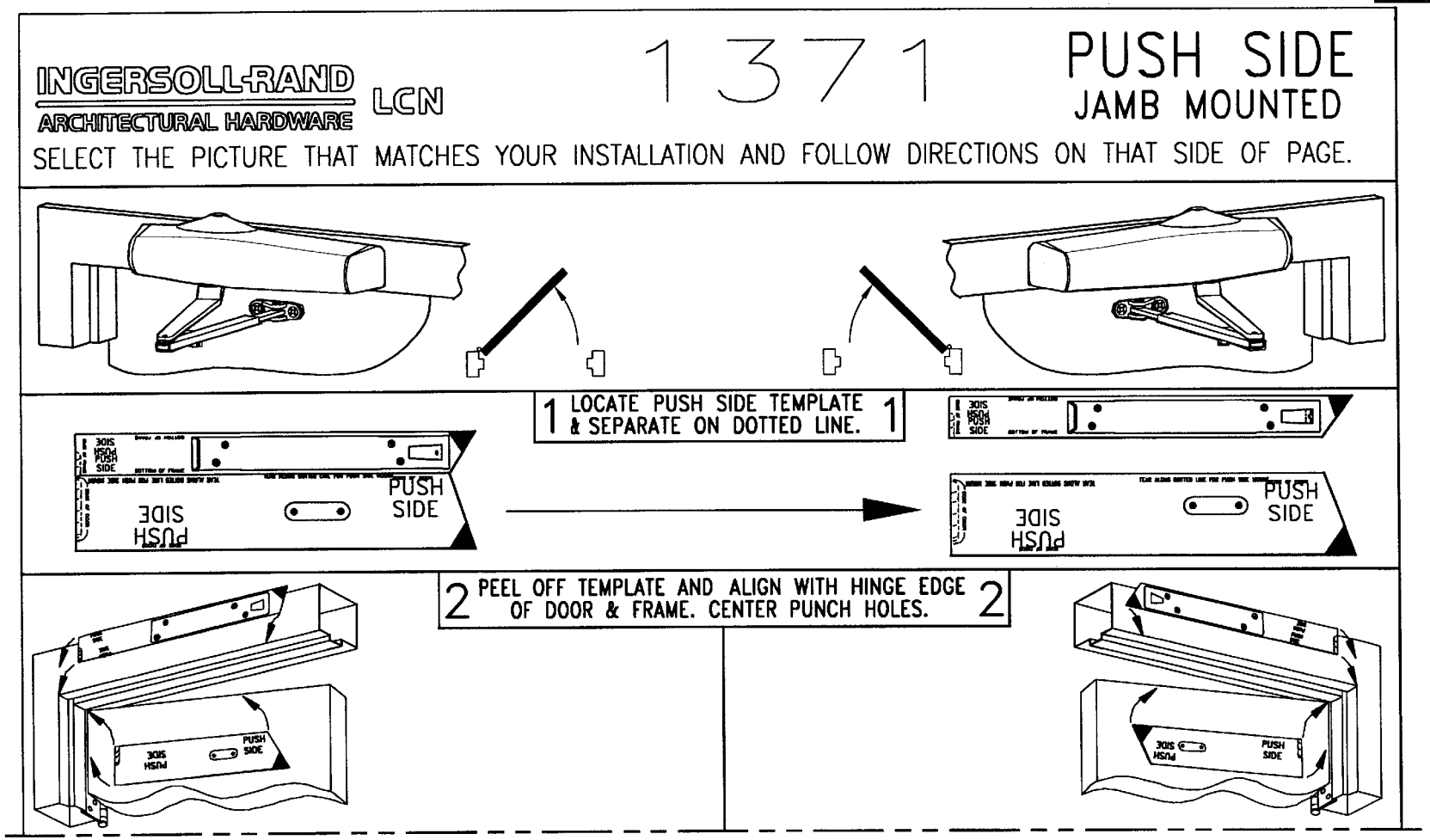
Figures 13, 13B:
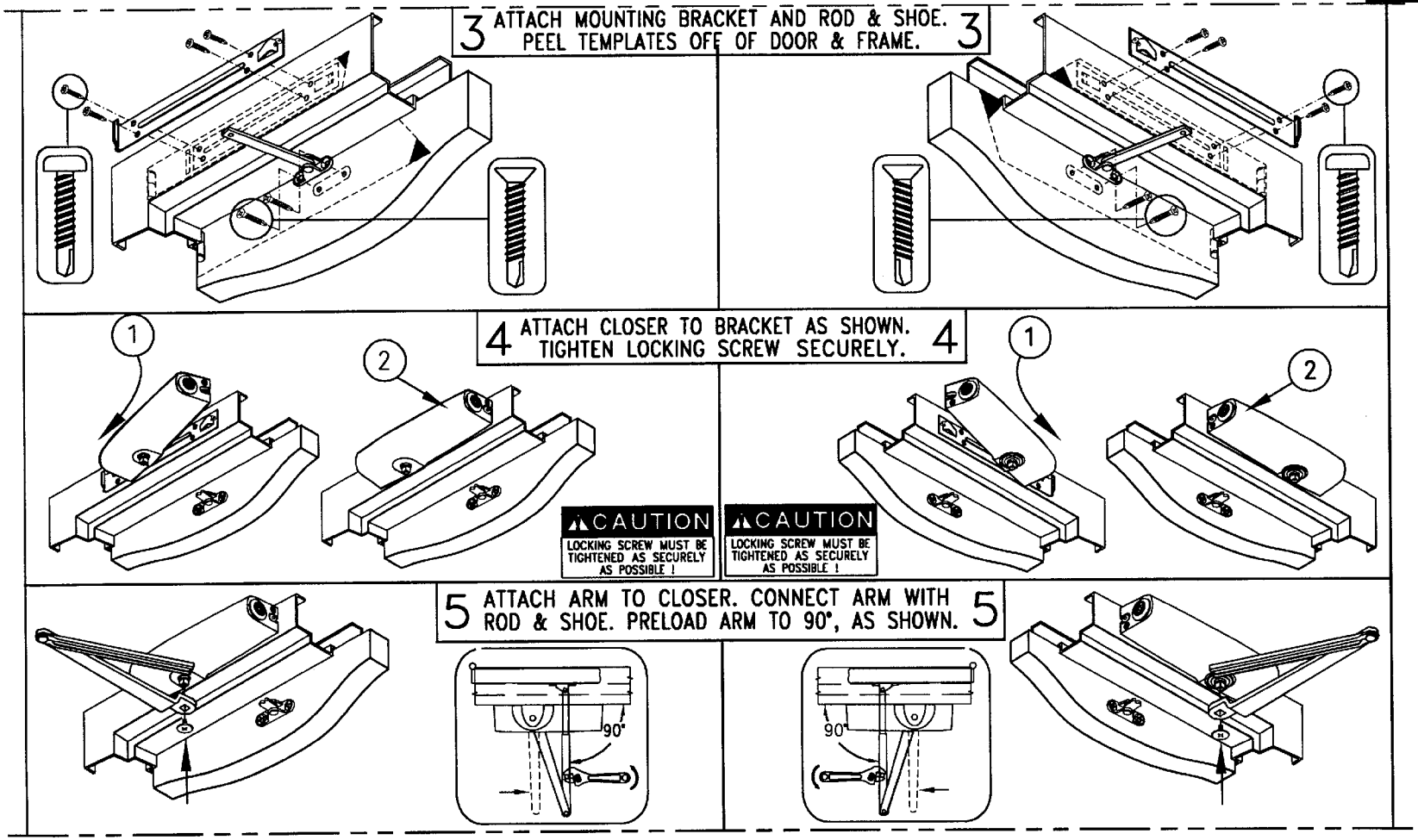
Figures 13, 13C:
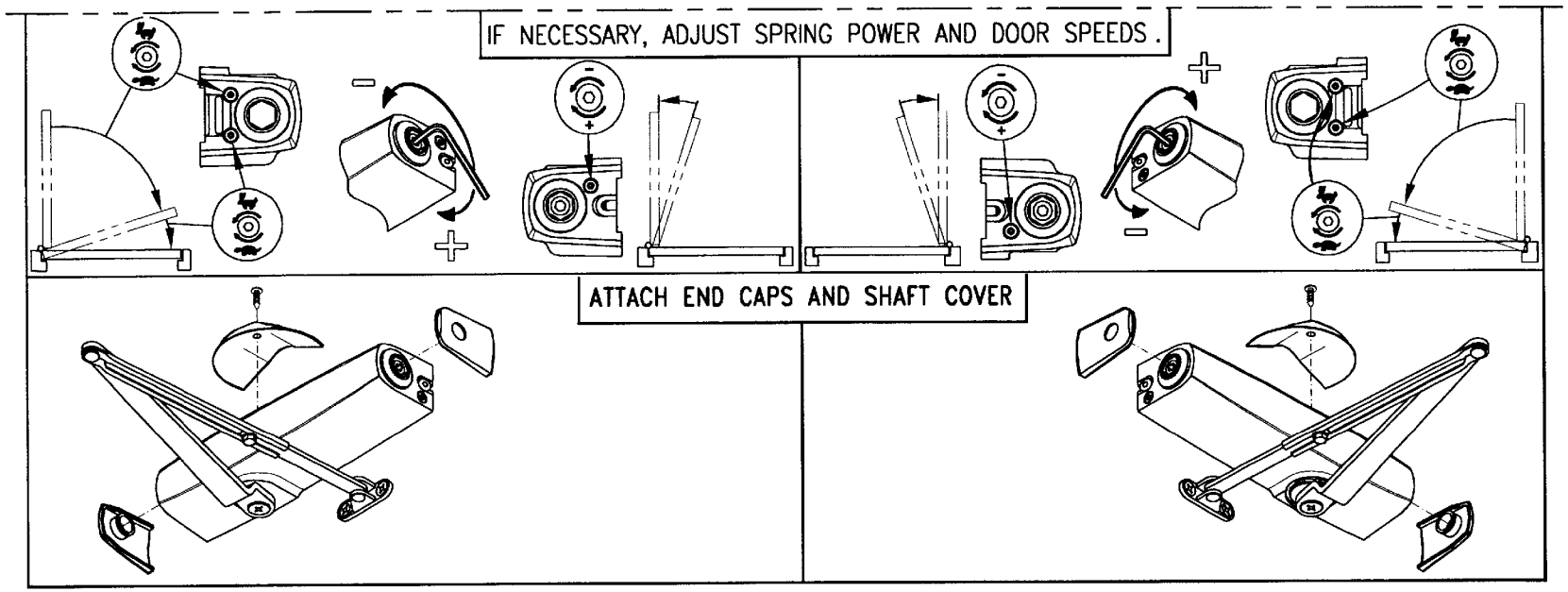

FIGS. 6A and 6B are front views of the pull side of the installation template illustrating the attachment of the template sections to the door and door frame showing both left hand and right hand doors; and FIGS. 7A and 7B are perspective views illustrating the attachment of the door closer mounting bracket and the rod and shoe bracket for pull side mounting showing both left hand and right hand doors;

FIGS. 8A and 8B are perspective views illustrating the attachment of the door closer to the mounting bracket showing both left hand and right hand doors;

FIGS. 9A and 9B are perspective views of a push side or jamb mounted door closer showing both left hand and right hand doors;

FIGS. 10A and 10B are front views of the push side of the installation template illustrating the attachment of the template sections to the door and door frame showing both left hand and right hand doors;

FIGS. 11A and 11B are perspective views illustrating the attachment of the door closer mounting bracket and the rod and shoe bracket for push side mounting showing both left hand and right hand doors;

FIGS. 12A, 12B and 12C are plan views of an instruction sheet for use with the pull side template shown in FIG. 1; and FIGS. 13A, 13B and 13C are plan views of an instruction sheet for use with the push side template shown in FIG. 2.

DETAILED DESCRIPTION

Figure 3:
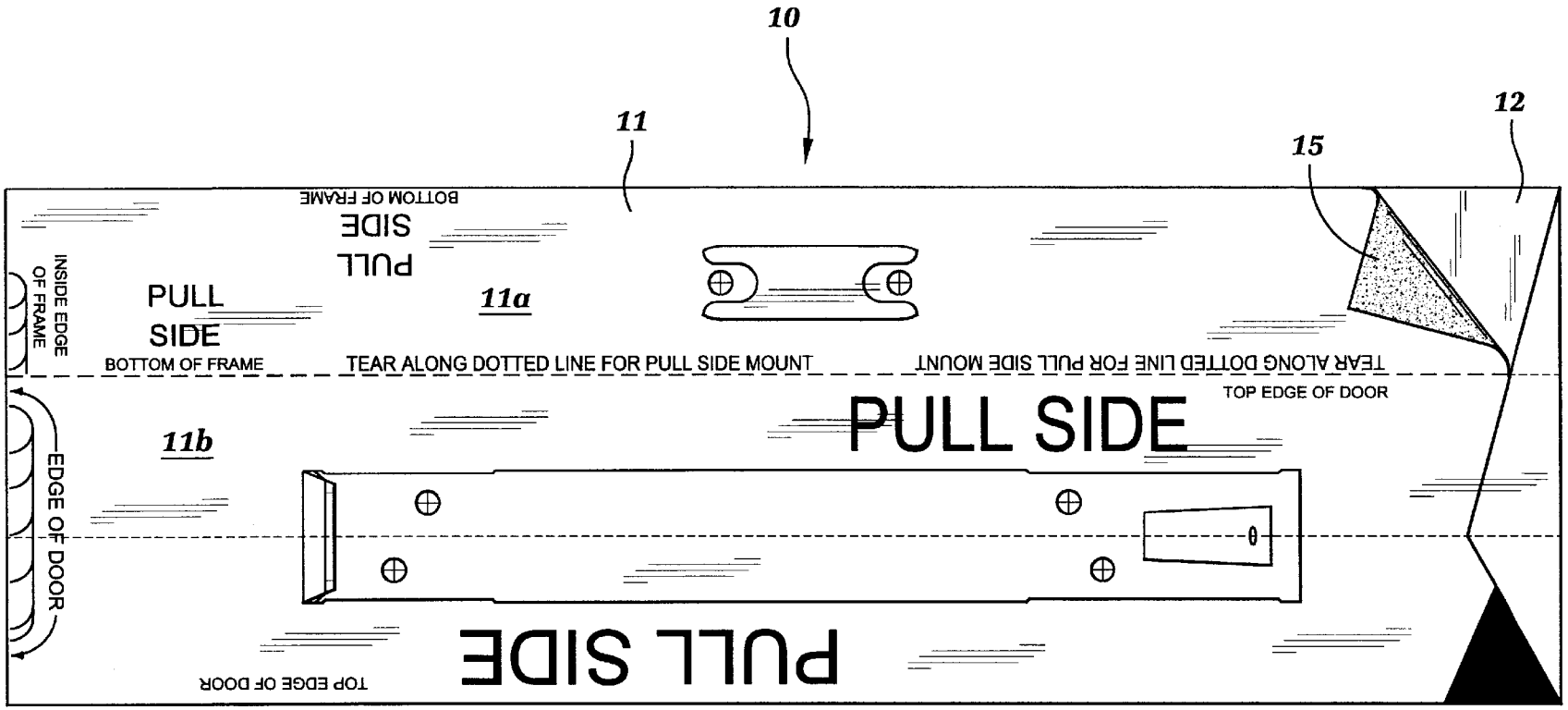
FIG. 3 is a front view of the pull side of the installation template shown in FIG. 1, illustrating the peel away attachment of the template sheets to the underlying paper.

FIGS. 1 through 3 show an installation template 10 for installing a door closer 62 and rod and shoe bracket 63 on a door 60 and door frame 61. The installation template 10 is formed from three sheets, an under sheet 12 coated with a release agent, a pull side template 11 having a self-stick adhesive 15 on the reverse side (as shown in FIG. 3) attached to one side of the under sheet 12 and a push side template 13 also having a self-stick adhesive on the reverse (similar to that shown in FIG. 3) attached to the other side of the under sheet 12. Both templates 11, 13 are divided into two sections, a door frame section 11*a*, 13*a* and a door section 11*b*, 13*b*, separable into the two by a tearable perforations 30. Preferably, two tearable perforations 30, offset from one another as shown in the FIGURES, are used to separate the template 10 into the two sections. As an alternative, the graphics on the pull side template 11 and the push side template 13 can be positioned such that only one perforation 30 is needed.

The two templates 11, 13 include graphics 24*a*, 24*b* representing a portion of a hinge to assist with proper installation and alignment of the templates 11, 13 on the door 60 and door frame 61 and includes graphics 32*a*, 32*b* showing the positioning of the door closer mounting bracket 62*a* and the rod and shoe bracket 63. Each template 11, 13 include sets of written instructions 40 identifying the template side as "PULL SIDE" or "PUSH SIDE" and indicating where the edge of the door frame section, "BOTTOM OF FRAME" or the edge of the door section, "TOP EDGE OF DOOR" is to be positioned. The written instructions 40 are in sets that are upside down relative to each other. This allows one template 11, 13 to be used for both right hand doors and left hand doors. When the template sections 11*a*, 11*b*, 13*a*, 13*b* are aligned with the hinge side 65 of the door 60 and door frame 61, one set of the written instructions 40 will be right side relative to the installer.

The templates 11, 13 further include cutout sections 21, 22. These cutout sections 21, 22, outlined by lines 25, 23, are fully cut out from the rest of the template 11, 13.

Figure 4A:
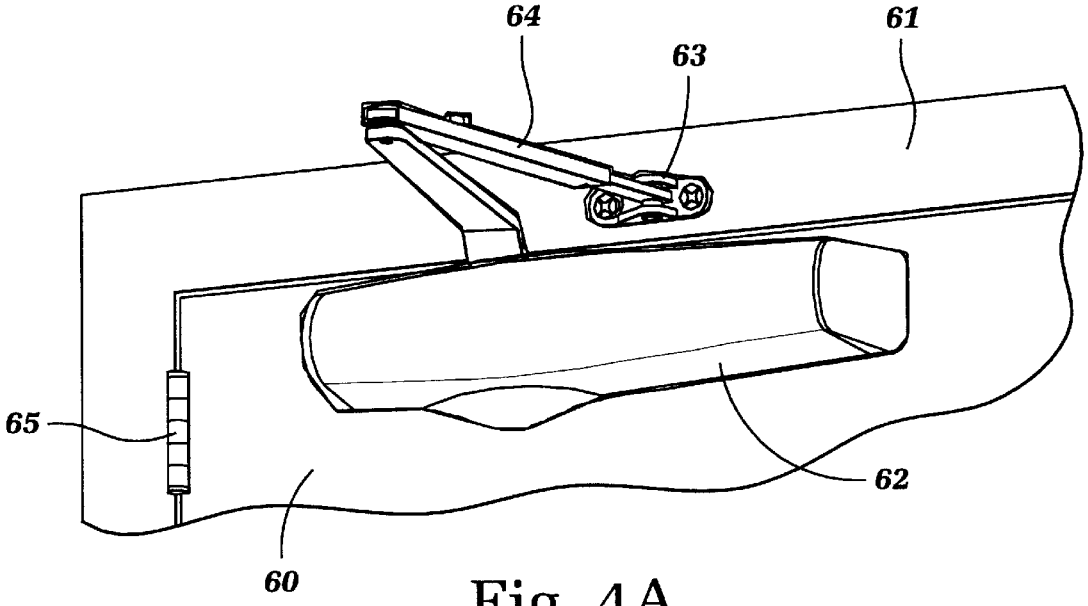
FIGS. 4A and 4B are perspective views of a pull side or door mounted door closer illustrating both left hand and right hand doors.
Figure 4B:
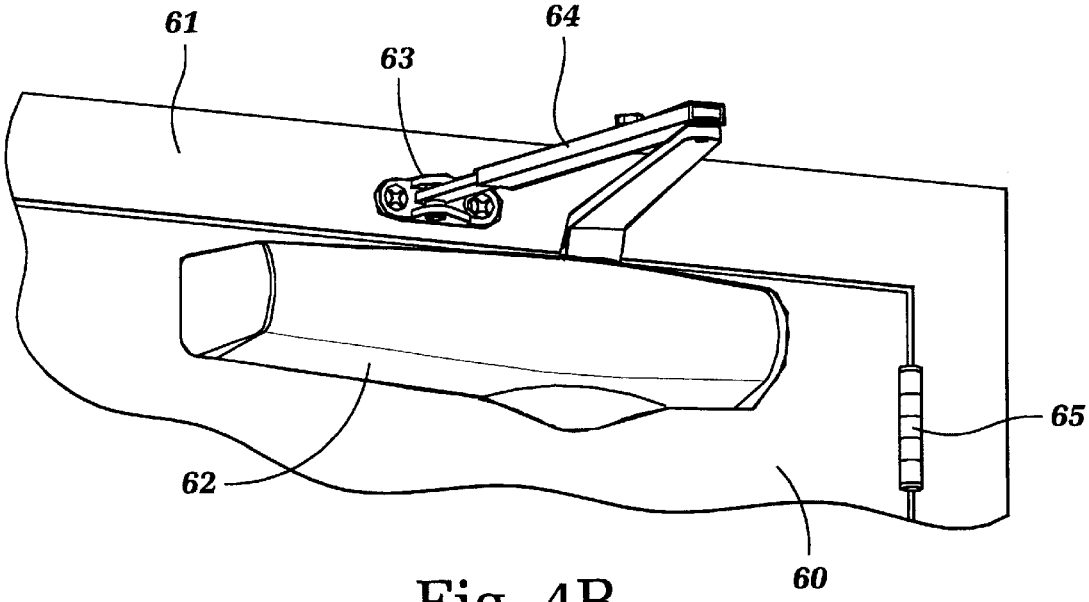
Figure 5:
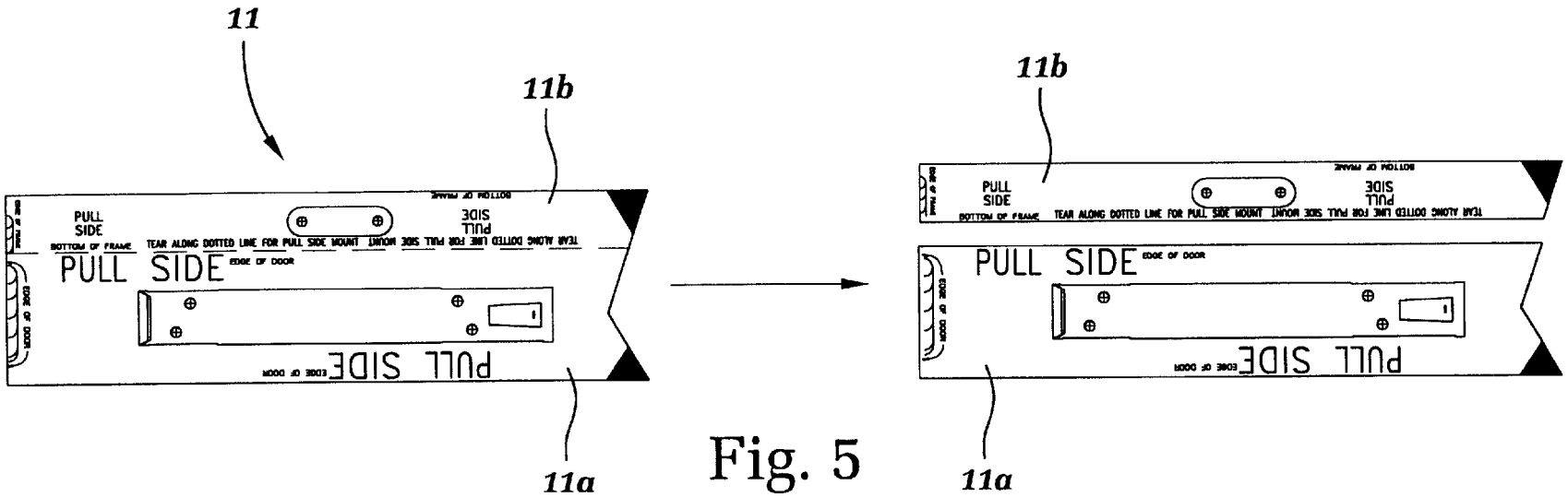
FIG. 5 is a front view of the pull side of the installation template illustrating the separation of the pull side of the installation template into the door frame section and the door section.

To install a door closer 62 using the installation template 10, the installer determines whether the door closer 62 is being installed as a pull side installation, where the door closer 62 is mounted on the side the door is pulled towards, or a push side installation, where the door closer 62 is mounted on the side the door 60 is pushed away from. In a pull side installation, the door closer 62 is mounted on the door 60 and the rod and shoe bracket 63 is mounted on the door frame 61. In a push side installation, the door closer 62 is mounted on the door frame 61 and the rod and shoe bracket 63 is mounted on the door 60. FIGS. 4A and 4B illustrate a pull side installation for both right hand and left hand doors. FIGS. 9A and 9B illustrate a push side installation for both right hand and left hand doors. (Pull side installations are shown in FIGS. 4A through 8B and push side installations are shown in FIGS. 9A through 11B.)

Once the type of installation is determined, the installer selects the appropriate side of the template 10, the pull side template 11 for pull side installations shown in FIGS. 4A and 4B, the push side template 13 for push side installation shown in FIGS. 9A and 9B. The appropriate template 11, 13 is then separated into the door frame section 11*a*, 13*a* and the door section 11*b*, 13*b*, shown in FIG. 5 for the pull side template 11, along perforation 30. After separation, the template sections 11*a*, 11*b* or 13*a*, 13*b* are separated from the under sheet 12, exposing the self-stick adhesive side of the template sections. The template sections 11*a*, 11*b* or 13*a*, 13*b* are then oriented with the hinge graphics 24*a*, 24*b* towards the hinge side 65 of the door 60. As shown in FIGS. 6A and 6B for pull side installations and FIGS. 10A and 10B for push side installations, the template sections 11*a*, 11*b* or 13*a*, 13*b* must be inverted for one of the door handings. Since the written instructions 40 are printed in two sets, one set of the written instructions 40 is always right side up for the installer to read. The template sections 11*a*, 11*b* or 13*a*, 13*b* are attached to the door 60 and door frame 61 using the self-stick adhesive side of the sections. After the template sections are attached to the door 60 and door frame 61, screw holes can be drilled, if necessary. Preferably, self-tapping screws are used, so that drilling screw holes is not needed. The door closer mounting bracket 62*a* is attached to the door or door frame, using the mounting bracket graphic 32*b* and the rod and shoe bracket 63 is attached to the door or door frame, as shown in FIGS. 7A, 7B, 11A and 11B, using the rod and shoe bracket graphic 32*a* for visual guidance. After the brackets are attached, the template sections 11*a*, 11*b* or 13*a*, 13*b* can be removed from the door and door frame. The cutout sections 21, 22 allowing the rest of the template sections 11*a*, 11*b* or 13*a*, 13*b* to cleanly separate from the cutout sections 21, 22. These cutout sections 21, 22 permit the template sections 11*a*, 11*b* or 13*a*, 13*b* to remain on the door after the brackets are installed. This is different than typical prior art installation templates where the template is taped to the door and door frame and is used as a drilling guide for the screw holes and then removed prior to the brackets being installed.

In the preferred embodiment, shown in. the FIGURES, a door closer 62 with a separate mounting bracket 62*a* is used. The installation of the door closer 62 on the mounting bracket 62*a* is shown in FIGS. 8A and 8B. After the door closer 62 and the rod and shoe bracket 63 are attached to the door 60 and door frame 61, the door closer arm 65 is connected between the door closer and the rod and shoe bracket. If desired, this installation template 10 could be used for a door closer which mounts directly to the door or door frame.

Having described the invention, what is claimed is:

1. A door closer installation device, comprising:

a releasable backing; and a template having a first side coated with a self-stick adhesive and coupled to the releasable backing and a second side including a left-hand visual mounting guide including left-hand instructions indicating the position in which to mount the template relative to a top edge of a door that is hinged along its left side and a right-hand visual mounting guide including right-hand instructions indicating the position in which to mount the template relative to the top edge of a door that is hinged along its right side, the left-hand instructions oriented approximately 180 degrees to the right-hand instructions.

2. The door closer installation device of claim 1, wherein the template further includes a cutout portion corresponding to part of both the left-hand visual mounting guide and the right-hand visual mounting guide.

* * * * *